US005334121A

United States Patent [19]

McPhilomy

[11] Patent Number: 5,334,121

[45] Date of Patent: Aug. 2, 1994

[54] INTERCHANGEABLE/ADJUSTABLE HURDLE

[76] Inventor: Charles E. McPhilomy, 8669 Garden Street Rd., Jacksonville, Fla. 32219

[21] Appl. No.: 61,729

[22] Filed: May 17, 1993

[51] Int. Cl.[5] ..... A63B 5/02

[52] U.S. Cl. ..... 482/17; 482/15

[58] Field of Search ..... 482/15-17, 482/908; 182/182; 211/203; 248/164

[56] References Cited

U.S. PATENT DOCUMENTS

| | | | |
|---|---|---|---|
| 2,583,786 | 1/1952 | Marzucco | 482/17 |
| 3,394,932 | 7/1968 | Leflar | 482/17 |
| 4,793,288 | 12/1988 | Hoadley | 482/16 |
| 5,033,737 | 7/1991 | Moye | 482/17 |
| 5,152,727 | 10/1992 | Moore et al. | 482/15 |
| 5,205,799 | 4/1993 | Carbonero | 482/16 |

FOREIGN PATENT DOCUMENTS

| | | | |
|---|---|---|---|
| 620447 | 4/1927 | France | 482/15 |
| 251500 | 1/1927 | Italy | 482/15 |
| 121587 | 7/1927 | Switzerland | 482/15 |
| 279965 | 11/1927 | United Kingdom | 482/15 |
| 743959 | 1/1956 | United Kingdom | 482/17 |

*Primary Examiner*—Robert Bahr

*Attorney, Agent, or Firm*—Michael K. Gray

[57] ABSTRACT

An interchangeable/adjustable hurdle component assembly made of a collection of interchangeable parts. The assembly has a plurality of leg support pairs of varying lengths which can be utilized as vertical leg supports or horizontal leg supports. One leg support pair is utilized as a first and second vertical leg support, and one leg support pair is utilized as a first and second horizontal leg support. The first vertical leg support is connected to a first tee and to a first elbow, and the second vertical leg support is connected to a second tee and second elbow. The vertical leg supports determine the height of the hurdle. The first horizontal leg support is connected to the first tee and the second horizontal leg support is connected to the second tee to provide support to the hurdle assembly. A crossbar connects to the first and second elbows. The component parts are tubular for realizing snap-fit connections. Both tees of the assembly are identical and interchangeable as are both elbows. By using a leg support pair of a desired length for the first and second vertical leg supports, an individual can adjust the height of the hurdle to a practice height which is suitable to that individual's level of skill.

10 Claims, 1 Drawing Sheet

INTERCHANGEABLE/ADJUSTABLE HURDLE

BACKGROUND OF THE INVENTION

1. Field of the Invention

The present invention relates to track and field equipment and more particularly relates to an interchangeable/adjustable hurdle having interchangeable components for adjusting the height of the hurdle and a method for using the same.

2. Discussion of the Background

In the art of running hurdles, a hurdler must learn to run over the hurdle as opposed to jumping and stepping over the hurdle. Many an otherwise promising hurdler has been dissuaded from taking up hurdles as an event due to the fear of falling or tripping over a hurdle. A full-size hurdle has seemed an imposing obstacle to many a would-be hurdler. The interchangeable/adjustable hurdle of the present invention allows a beginning hurdler to practice hurdling at a hurdle height which the beginning hurdler can run over without excessive effort and strain and begin to develop proper form. As the beginning hurdler develops technique and ease of hurdling at a particular height the hurdle can be adjusted to a greater height as the beginning hurdler progresses to a full-hurdle height.

SUMMARY OF THE INVENTION

Accordingly one object of the present invention is to provide an inexpensive interchangeable/adjustable hurdle.

Yet another object of the present invention is to provide an interchangeable/adjustable hurdle whose height is easily adjusted through the use of interchangeable parts.

Still another object of the present invention is to provide a method for teaching hurdling and hurdling form through the use of the interchangeable/adjustable hurdle of the present invention.

These and other valuable objects and advantages, according to the present invention, are provided by an interchangeable/adjustable hurdle which is comprised of a first tee having a vertical insert region and at least one horizontal insert region. A second tee is likewise provided with a vertical insert region and at least one horizontal insert region. A first elbow is provided with a smoothed walled vertical insert region and a smooth walled horizontal insert region, and a second elbow is provided with a smoothed walled vertical insert region and a smoothed walled horizontal insert region.

A crossbar is connected to the horizontal insert region of the first elbow and to the horizontal insert region of the second elbow. An integral first horizontal leg support means consisting of a first horizontal leg support is connected to a horizontal insert region of the first tee, and an integral second horizontal leg support consisting of a second horizontal leg support is connected to a horizontal insert region of the second tee.

A first vertical leg support connects to the vertical insert region of the first tee and connects to the vertical insert region of the first elbow. A second vertical leg support connects to the vertical insert region of the second tee and connects to the vertical insert region of the second elbow.

The first and second vertical leg supports are identical in length, and the first and second horizontal leg supports are identical in length. The first horizontal leg support can be interchanged with the first vertical leg support and the second horizontal leg support can be interchanged with the second vertical leg support to change the height of the interchangeable adjustable hurdle. Further, a plurality of additional leg support pairs are provided which can be used and interchanged as horizontal and vertical leg supports.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings wherein.

When referring to the drawings, it should be understood that like reference numerals designate identical or corresponding parts throughout the respective figures.

THE DETAILED DESCRIPTION OF THE INVENTION

Figure 1:
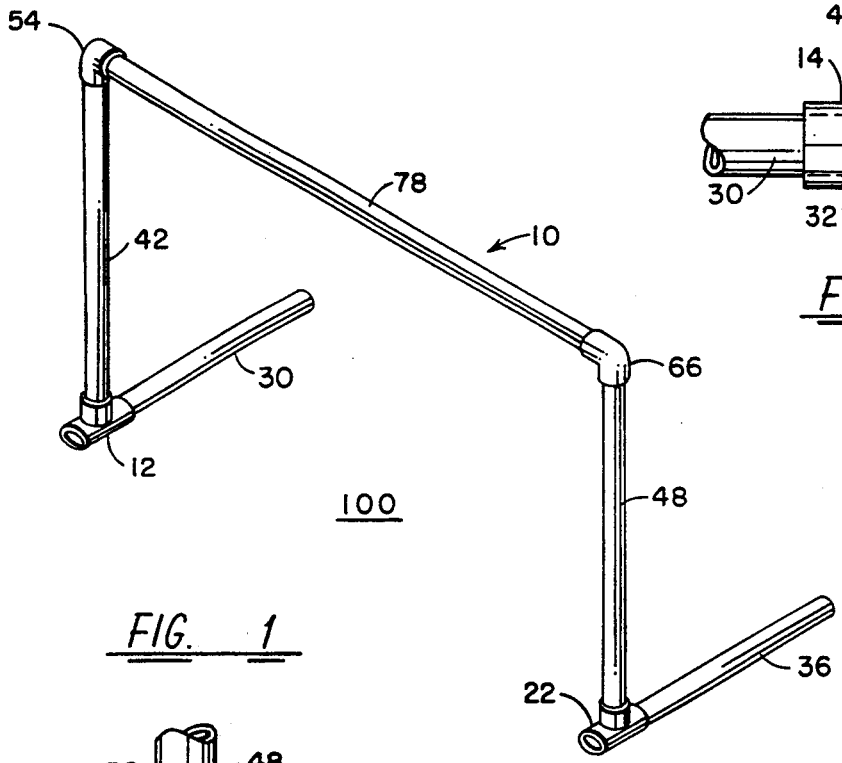
FIG. 1 is a perspective illustration of the interchangeable/adjustable hurdle according to the present invention.

With reference to FIG. 1, the interchangeable/adjustable hurdle 10, which in the prototype of the present invention was made entirely of PVC pipe threadless, is provided with a first tee 12 and a second tee 22. A first horizontal leg support 30 is connected to the first tee 12 and a second horizontal leg support 36 is connected to the second tee 22.

Still with reference to FIG. 1, a first elbow 54 and a second elbow 66 connect in horizontal fashion to crossbar 78. A first vertical leg support 42 connects to the first elbow 54 and to the first tee 12 such that the first tee 12 and the first elbow 54 are in vertical alignment. A second vertical leg support 48 connects to the second elbow 66 and to the second tee 22 such that the second tee 22 and second elbow 66 are in vertical alignment. The crossbar 78 which is supported by the first vertical leg support 42 and the second vertical leg support 48 is parallel to the ground 100.

The first vertical leg support 42 and the second vertical leg support 48 are identical to one another and of a fixed length.

Figure 2A:
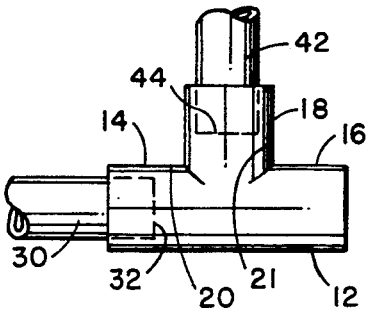
FIG. 2A is a closeup see-through, side-view illustration depicting the first tee of the present invention connected to the first horizontal leg support and first vertical leg support according to the present invention.
Figure 2B:
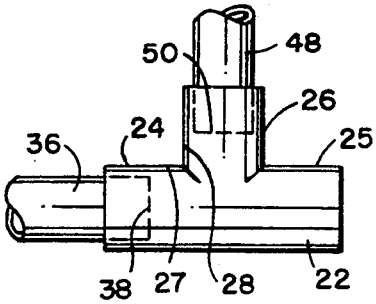
FIG. 2B is a closeup see-through, side-view illustration depicting the second tee of the present invention connected to the second horizontal leg support and second vertical leg support according to the present invention.

With reference to FIGS. 2A and 2B, it is understood that first tee 12 and second tee 22 are identical.

First tee 12 has a first horizontal insert region 14 and a second horizontal insert region 16 . The second horizontal insert region is opposite to the first horizontal insert region 14. The top of first tee 12 is provided with a vertical insert region 18.

A connecting end 32 of the first horizontal leg support 30 is inserted into the first horizontal insert region 14 of the first tee 12 and contacts the smooth inner wall 20 of the first horizontal insert region 14 of the first tee 12 to provide a friction-fit connection. A tee connecting end 44 of the first vertical leg support 42 is inserted into the vertical insert region 18 of the first tee 12 and contacts the smooth inner wall 21 of the vertical insert region 18 to provide a threadless friction-fit connection.

Second tee 22 has a first horizontal insert region 24 and a second horizontal insert region 25. The second horizontal insert region 25 is opposite to the first horizontal insert region 24. The top of second tee 22 is provided with a vertical insert region 26. A connecting end 38 of the second horizontal leg support 36 is inserted into the first horizontal insert region 24 of the second tee 22 and contacts the smooth inner wall 27 of the first horizontal insert region 24 of the second tee 22 to provide a threadless friction-fit connection. A tee connecting end 50 of the second vertical leg support 48 is inserted into the vertical insert region 26 of the second tee 22 and contacts the smooth inner wall 28 of the vertical insert region 26 to provide a threadless friction-fit connection.

Figure 3:
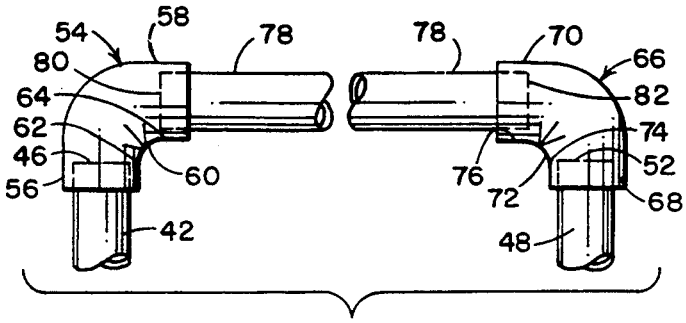
FIG. 3 is a closeup-see through illustration depicting how the first and second elbows of the present invention are connected to the crossbar according to the present invention.

With reference to FIG. 3, first elbow 54 is provided with a vertical insert region 56 and a horizontal insert region 58. The first elbow 54 is molded or shaped so as to form a 90° bend 60. The elbow connecting end 46 of the first vertical leg support 42 is inserted into the vertical insert region 56 of the first elbow 54 and contacts the smooth inner wall 62 of the vertical insert region 56 to provide a threadless friction-fit connection.

The second elbow 66 is provided with a vertical insert region 68 and a horizontal insert region 70. The second elbow 66 is molded or shaped so as to form a 90° bend 72. The elbow connecting end 52 of the second vertical leg support 48 is inserted into the vertical insert region 68 of the second elbow 66 and contacts the smooth inner wall 74 of the vertical insert region 68 to provide a threadless friction-fit connection.

The crossbar 78 is provided with a first elbow insertion end 80 and a second elbow insertion end 82. The first elbow insertion end 80 of the crossbar 78 is inserted into the horizontal insert region 58 of the first elbow 54 and contacts the smooth inner wall 64 of the horizontal insert region 58 to provide a threadless friction-fit connection. The second elbow insertion end 82 of the crossbar 78 is inserted into the horizontal insert region 70 of the second elbow 66 and contacts the inner wall smooth 76 of the horizontal insert region 70 to provide a threadless friction-fit connection.

Figure 4:
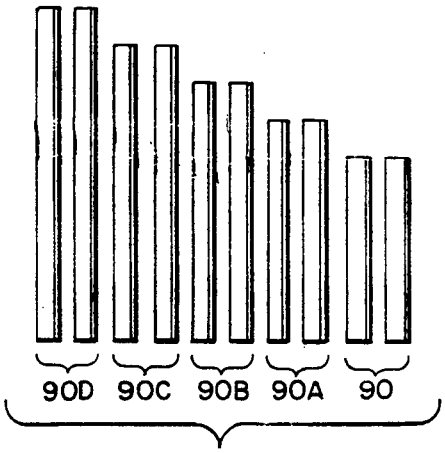
FIG. 4 is a comparative view of the plurality of leg supports according to the present invention.

FIG. 4 illustrates the plurality of leg support pairs (90, 90A, 90B, 90C, 90D) which are provided with the present invention. Pairs 90, 90A, 90B, 90C, and 90D each consist of identical first and second leg supports. Each pair 90 can be utilized to provide a first vertical leg support 42 and a second vertical leg support 48 or each pair 90 can be utilized to provide a first horizontal leg support 30 and second a horizontal leg support 36 (see FIG. 1).

Figure 5:
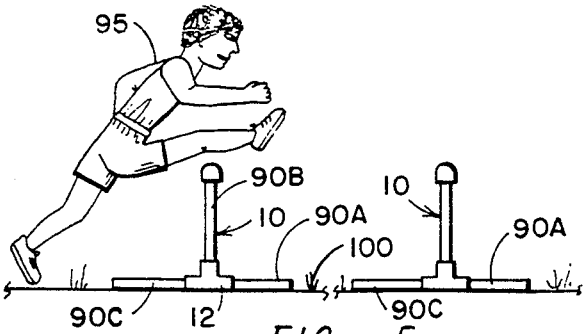
FIG. 5 is an exemplary illustration demonstrating the interchangeable/adjustable hurdle of the present invention in use.

In FIG. 5, a hurdler 95 is shown hurdling over an interchangeable/adjustable hurdle 10 according to the present invention. A plurality of interchangeable adjustable hurdles 10 are arranged on the track or ground 100 so that the hurdler 95 can practice form and technique at a workable height and progress on to a greater hurdle height as skill and form improve. FIG. 5 demonstrates that the interchangeable adjustable hurdle can be used such that a first horizontal leg support (shown in FIG. 5 as support 90C) is connected to the first horizontal insert region 14 of the first tee 12 and a third leg support (shown in FIG. 5 as support 90A) is connected to the second horizontal insert region 16 of the first tee. Likewise (although not shown in FIG. 5) a second horizontal leg support 90C is connected to the first horizontal insert region 24 of the second tee 22 and a fourth horizontal leg support 90A is connected to the second horizontal insert region 25 of the second tee 22. The first and second horizontal lea supports are equal in length, and the third and fourth horizontal leg supports are equal in length.

To utilize the interchangeable/adjustable hurdle 10 of the present invention it is first necessary to select a pair of vertical leg supports (e.g. leg support pair 90 of FIG. 4) to be used as the first vertical leg support 42 and the second vertical leg support 48.

The leg support pair 90 being chosen as an appropriate length when considering the current degree of experience and skill of the individual who is to be practicing hurdling with the interchangeable/adjustable hurdle 10.

After an individual becomes proficient at hurdling at a given crossbar height, a longer leg support pair (e.g. leg supports 90B) can replace the leg support pair 90A and the individual can continue to practice and replace the leg support pairs until a regulation hurdle height is achieved.

In the prototype of the present invention, the interchangeable/adjustable hurdle 10 was comprised entirely of one-inch PVC pipe. The crossbar measured 36" in length, and the leg supports pairs measured 24", 21", 18", 15" and 12" in length, respectively. The prototype of the present invention was further comprised of two PVC one-inch elbows and the two PVC one-inch tees. The interchangeable/adjustable hurdle 10 can be made of other suitable materials and can be alternatively designed such that the elbows are inserted into the crossbar, and vertical leg supports and tees are inserted into the horizontal and vertical leg supports. The practice-hurdle height realized by the prototype of the present invention was approximately three inches higher than the length of the leg support pair used as the vertical support legs.

The interchangeable/adjustable hurdle of the present invention is, due to the tubular and hollow construction of its components, and will not impede a runner's stride or trip the runner when struck. A forceful impact with the crossbar 78 results in the interchangable/adjustable hurdle 10 falling apart without damage to the runner or parts of the interchangeable/adjustable hurdle. When the hurdle height is set at a low elevation, a runner may hurdle the interchangable/adjustable hurdle 10 from either direction (see FIG. 5).

The components of the interchangeable/adjustable hurdle 10 are stackable for easy storage, are easily carried and are easily assembled and disassembled. One interchangeable/adjustable hurdle 10 (see FIG. 5) can be quickly and easily adjusted to three different heights with the parts that are already assembled.

The interchangeable/adjustable hurdle of the present invention provides an inexpensive and effective tool for teaching and promoting the track event of hurdling and will serve to augment participation in the hurdle events.

The foregoing detailed description is intended to be illustrative and non-limiting. Many changes and modifications are possible in light of the above teachings. Thus, it is understood that the invention may be practiced otherwise than as specifically described herein and still be within the scope of the appended claims.

What is claimed is:

1. An interchangeable/adjustable hurdle, comprising:

a first tee, said first tee having a vertical insert region and a first horizontal insert region;

a second tee, said second tee having a vertical insert region and a first horizontal insert region;

an integral first horizontal leg support means consisting of a first horizontal leg support connected to said first tee;

an integral second horizontal leg support means consisting of a first horizontal leg support connected to said first tee;

an integral second horizontal leg support means consisting of a second horizontal leg support connected to said second tee;

a first elbow comprised of a smooth-walled vertical insert region and smooth-walled horizontal insert region;

a second elbow comprised of a smooth-walled vertical insert region and a smooth-walled horizontal insert region;

a first vertical leg support of fixed length connected to said first tee and to said first elbow, said first vertical by support having a said tee connecting end connected to said first tee and an elbow connecting end connected to said first elbow, said elbow connecting end of said first vertical leg support contacts said smooth-walled vertical insert region of said first elbow to provide a threadless friction-fit connection;

a second vertical leg support of fixed length connected to said second tee and to said second elbow, said second vertical leg support having a tee connecting end connected to said second tee and an elbow connecting end connected to said second elbow, said elbow connecting end of said second vertical leg support contacts said smooth-walled vertical insert region of said second elbow to provide a threadless friction-fit connection;

a crossbar having a first elbow insert end and a second elbow insert end, said first elbow insert end of said crossbar contacts said smooth-walled horizontal insert region of said first elbow to provide a threadless friction-fit connection and said second elbow insert end of said crossbar contacts said smooth-walled horizontal insert region of said second elbow to provide a threadless friction-fit connection; and wherein said first and second vertical leg supports are identical in length.

2. An interchangeable/adjustable hurdle according to claim 1, wherein:

said first and second horizontal leg supports are identical in length, and said first horizontal leg support can be interchanged with said first vertical leg support and said second horizontal leg support can be interchanged with said second vertical leg support to change the height of said interchangeable/adjustable hurdle.

3. An interchangeable/adjustable hurdle according to claim 1, wherein:

said first horizontal leg support has a horizontal connecting end inserted into the first horizontal insert region of said first tee, the horizontal connecting end of said first horizontal leg support making contact with an inner wall of the first horizontal insert region of said first tee.

4. An interchangeable/adjustable hurdle according to claim 3, wherein:

said second horizontal leg support has a connecting end inserted into the first horizontal insert region of said second tee, the connecting end of said second horizontal leg support making contact with an inner wall of the first horizontal insert region of said first tee.

5. An interchangeable/adjustable hurdle according to claim 1, wherein said first and second vertical leg supports are parallel to one another.

6. An interchangeable/adjustable hurdle according to claim 1, wherein said first and second horizontal leg supports are parallel to one another.

7. An interchangeable/adjustable hurdle according to claim 6, wherein said crossbar is parallel to the ground and perpendicularly aligned with said first and second horizontal leg supports.

8. An interchangeable/adjustable hurdle according to claim 7, wherein said first vertical leg support is perpendicularly aligned with said first horizontal leg support.

9. An interchangeable/adjustable hurdle according to claim 8, wherein said second vertical leg support is perpendicularly aligned with said second horizontal leg support.

10. An interchangeable/adjustable hurdle according to claim 1, wherein:

said first tee, said second tee, said first horizontal leg support, said second horizontal leg support, said first elbow, said second elbow, said first vertical leg support, said second vertical leg support, and said crossbar are tubular and hollow.

* * * * *